US011685579B2

(12) United States Patent
Bottger

(10) Patent No.: US 11,685,579 B2
(45) Date of Patent: Jun. 27, 2023

(54) CONTAINER WITH A LID AND THREADED CLOSURE MECHANISM

(71) Applicant: Bettina Bottger, Estoril (PT)

(72) Inventor: Bettina Bottger, Estoril (PT)

( * ) Notice: Subject to any disclaimer, the term of this patent is extended or adjusted under 35 U.S.C. 154(b) by 615 days.

(21) Appl. No.: 16/537,001

(22) Filed: Aug. 9, 2019

(65) Prior Publication Data

US 2020/0047957 A1 Feb. 13, 2020

(30) Foreign Application Priority Data

Aug. 9, 2018 (ES) ..... ES201831263U

(51) Int. Cl.

| | |
|---|---|
| ***B65D 53/02*** | (2006.01) |
| ***B65D 43/02*** | (2006.01) |
| ***B65D 45/30*** | (2006.01) |
| ***B65D 51/18*** | (2006.01) |
| ***B65D 51/14*** | (2006.01) |

(52) U.S. Cl.

CPC ..... *B65D 53/02* (2013.01); *B65D 43/0231* (2013.01); *B65D 45/305* (2013.01); *B65D 51/145* (2013.01); *B65D 51/18* (2013.01); *B65D 2251/0018* (2013.01); *B65D 2251/0068* (2013.01)

(58) Field of Classification Search

CPC .. B65D 53/02; B65D 43/0231; B65D 45/305; B65D 51/145; B65D 51/18; B65D 2251/0018; B65D 2251/0068

USPC ..... 215/11.1–11.6, 276, 349, 350; 220/259.3, 304, 319, 327

See application file for complete search history.

(56) References Cited

U.S. PATENT DOCUMENTS

| | | | | |
|---|---|---|---|---|
| 496,561 | A * | 5/1893 | Garvie | B65D 47/122 220/259.3 |
| 1,602,346 | A | 10/1926 | Eller | |
| 3,924,772 | A * | 12/1975 | Magnani | B65D 51/145 215/354 |
| 5,727,706 | A * | 3/1998 | Richter | H02G 3/0675 220/3.2 |
| 5,875,906 | A * | 3/1999 | Price | B65D 55/0863 215/276 |
| 8,550,268 | B1 | 10/2013 | Chisholm | |
| 2003/0034322 | A1 * | 2/2003 | Doherty | B65D 41/0485 215/277 |

* cited by examiner

*Primary Examiner* — James N Smalley

(74) *Attorney, Agent, or Firm* — Eugenio J. Torres-Oyola; Victor M. Rodriguez-Reyes; Rafael Rodriguez-Muriel

(57) ABSTRACT

The container with a lid and threaded closure mechanism includes a receptacle having a mouth surrounded by a thread, a lid, a sealing ring and a closure mechanism formed by a disc with a hollow interior and a perimetral tubular skirt provided with an engagement configuration complementary to the thread of the receptacle. The closure mechanism surrounds the lid and holds it against the mouth of the receptacle by means of a threaded attachment between the engagement configuration of the closure mechanism and the thread of the receptacle, assuring proper hermetic closure of the lid with the receptacle in cooperation with the sealing ring. The lid and the closure mechanism have mutually engaging elements with a complementary non-circular geometry and size, with both elements being tightly fitted preventing relative rotation of the closure mechanism with respect to the lid.

21 Claims, 6 Drawing Sheets

CONTAINER WITH A LID AND THREADED CLOSURE MECHANISM

TECHNICAL FIELD

The present invention relates to the field of containers with a lid and threaded closure mechanism, the containers being of the type including a receptacle having a mouth surrounded by a thread, a lid, and a closure mechanism formed by a disc with a hollow interior and a perimetral tubular skirt provided with an engagement configuration complementary to the thread of the receptacle.

The closure mechanism surrounds the lid and holds it against the mouth by means of the threaded attachment between the engagement configuration of the closure mechanism and the thread of the receptacle, assuring proper hermetic closure of the lid with the receptacle.

STATE OF THE ART

Containers provided with a receptacle and a lid held against the mouth of the receptacle by means of a closure mechanism formed by a disc with a hollow interior and a perimetral skirt provided with an engagement configuration complementary to a thread of the receptacle have been known for over a hundred years.

The oldest and most well-known containers of this type are those known as Mason jars which have been marketed by Mason since the end of the 19th century in the form of glass receptacle and lids.

Since then, there have been registrations for containers of this type, incorporating minor system variations or improvements. For example, document U.S. Pat. No. 1,602,346A or document U.S. Pat. No. 8,550,268B1 describe containers of this type.

However, in known containers of this type the closure mechanism is not attached to the lid, so the lid is separated from the closure mechanism after opening the container.

DISCLOSURE OF THE INVENTION

The present invention relates to a container with a threaded hermetic closure including:

- a receptacle provided with a mouth including a receptacle opening, an annular mouth surface surrounding said receptacle opening, and a thread externally surrounding said mouth;
- a lid with a front side and a back side, said lid including an annular perimetral flange which, in a closed position, is superimposed on the annular mouth surface of the receptacle, and at least one central rib protruding from the front side of the lid;
- a sealing ring arranged and held between the annular mouth surface of the receptacle and the annular flange of the lid;
- a closure mechanism movable between a closed position and an open position, the closure mechanism being formed by a tubular skirt with a first open end and a second end closed by means of an annular disc attached along its outer perimeter to the tubular skirt, said tubular skirt being provided with an engagement configuration complementary to the thread of the receptacle; wherein
  - the lower surface of the tubular skirt surrounds and defines a first insertion passage the size of which is equal to or greater than the external size of the annular flange of the lid and the depth of which is greater than the thickness of the annular flange; and
  - the annular disc has in the center thereof a hole the inner perimeter of which surrounds and defines a second insertion passage in the center thereof, the size of which is smaller than the size of the first insertion passage and the external size of the annular flange and greater than or equal to the size of the at least one central rib of the lid;

wherein in the closed position the annular flange is inserted into the first insertion passage and in contact with the annular disc of the closure mechanism, the at least one central rib is inserted into the second insertion passage, the tubular skirt is arranged around the mouth, and the engagement configuration of the closure mechanism is coupled to the thread.

The lower surface of the tubular skirt is understood to be its inner face, not accessible from the outside but accessible through the first insertion passage.

The threaded hermetic closure determines that the thread is circular, and therefore the mouth will also preferably be tubular. This preferably determines that the general configuration of the annular flange of the lid and the closure mechanism also have a general circular geometry to be adapted to said tubular mouth.

The back side of the lid is envisaged for being oriented, in a closed position, towards the receptacle opening, the front side being the opposite face of the lid in which the at least one central rib is located.

The closure mechanism is provided for screwing the engagement configuration on the thread of the receptacle, holding the lid against the receptacle achieving hermetic closure thereof. More specifically, the annular disc of the closure mechanism will be superimposed on the annular flange of the lid in the closed position, pressing it against the annular mouth surface of the receptacle.

It is furthermore understood that when it is specified that two linked or fitted elements are of the same size, the possibility of there being small differences in size making it necessary to apply a certain force and there being small elastic deformation of one of the elements so that they can be fitted and inserted with respect to one another is also contemplated.

The sealing ring will preferably be made of a flexible or elastomeric material that is, however, air-tight, such as plastics, soft plastics, gums, latex, or rubber, for example.

The invention furthermore proposes, in a manner not known in the state of the art, the inclusion of means so that the movement of opening the closure mechanism, by means of unscrewing it from the mouth, causes the vacuum inside the container to break, by means of the joint rotation of the closure mechanism with the lid.

The combination of pulling on the lid, moving it away from the receptacle, and rotating same will assure the breaking of hermetic sealing and the entry of air into the container.

For the joint rotation of the closure mechanism and the lid, it is proposed, in a manner not known in the existing state of the art, for at least:

- the lower surface of the tubular skirt defining the first insertion passage and the perimetral area of the annular flange facing the lower surface of the tubular skirt; or
- the inner perimeter of the hole of the annular disc defining the second insertion passage and the perimetral area of the central rib facing said inner perimeter of the hole of the annular disc to have a complementary non-circular geometry and size, with both elements being tightly fitted preventing relative rotation of the closure mechanism with respect to the lid.

This joint rotation of the lid with the closure mechanism causes the lid to rotate with respect to the receptacle once the closure mechanism is unscrewed, thereby facilitating the entry of air into the receptacle and the breaking of the vacuum which may exist inside the container.

A complementary size is understood to be that which allows the insertion of an element into the corresponding passage, even if certain force and elastic deformation is required to cause said insertion.

Likewise, a complementary size which prevents relative rotation is understood to be that size which will cause an interference of the insertion passage with the element inserted therein along its rotating path. For example, in most geometries, it is considered that a size difference equal to or less than 3 mm should provide said effect, unless these geometries are very close to the circular geometry.

It is considered that a circular geometry concentric with the thread will not allow obtaining the desired effect of causing the joint rotation of the closure mechanism with the lid. However, it is considered that other geometries will indeed cause said effect.

Therefore, two solutions are proposed to achieve the joint rotation of the closure mechanism with the lid.

On one hand, it is proposed that neither the central rib of the lid nor the second insertion passage will be circular, with both elements having complementary geometries and sizes and therefore producing a coupling which prevents their relative rotation.

On the other hand, it is proposed that neither the annular flange nor the first insertion passage will be circular, with both elements having complementary geometries and sizes and therefore producing a coupling which prevents their relative rotation.

By way of non-limiting example, it is proposed that the central rib will be in the shape of a polygon, ellipse, sinuous contour, star, cross, symbol, letter, word, number, or a truncated circular shape or circular shape with notches on the perimeter thereof.

Also by way of non-limiting example, it is proposed that the perimetral area of the annular flange will be in the shape of a polygon, flute, sinuous contour, or a truncated circular shape or circular shape with notches on the perimeter thereof.

According to another additional embodiment of the invention, it is proposed that a retainer element will be connected to the closure mechanism constricting the first insertion passage retaining the annular flange such that it is attached to the closure mechanism preventing the removal of the lid.

Alternatively, the retainer element may be connected to the closure mechanism constricting the second insertion passage, portions of the retainer element being inserted into portions of side grooves located in areas of the at least one central rib of the lid located at two different halves of the lid, retaining the at least one central rib such that it is attached to the closure mechanism preventing the removal of the lid.

In other words, it is proposed to include a retainer element which, in collaboration with the closure mechanism, reduces the free section of the first or second insertion passage of the closure mechanism preventing the removal of the lid from inside the closure mechanism.

This allows the closure mechanism to remain attached to the lid even in the open position, preventing the loss of one of these elements, and preventing the lid from accidentally falling out from inside the closure mechanism, which may cause said lid to break if it is made of a fragile material such as glass or ceramic.

When opening the container, the rotation of the closure mechanism in collaboration with the thread causes the distancing of the closure mechanism with respect to the annular mouth surface of the receptacle. The proposed retainer element will cause said distancing to pull the lid along as well, moving it away from the annular mouth surface, which will help to break the vacuum that may exist inside the container while it is being unscrewed at the same time, facilitating the entry of air therein.

In the closed position, the lid is inserted into the closure mechanism through the first insertion passage, with the annular flange being in contact with the annular disc closing the bottom of the first insertion passage and the at least one annular rib being inserted into the second insertion passage.

Since the depth of the tubular skirt is greater than the thickness of the annular flange, in the closed position only a part of the tubular skirt will be arranged around the annular flange, the retainer element being positioned in the rest of the tubular skirt that will be arranged below the mentioned annular flange, the receptacle being in a vertical position with its mouth at the upper end.

The receptacle and/or the lid can be made of glass or ceramic, although alternatively the use of plastic is also contemplated.

According to a first alternative of the invention, the retainer element will cause the first insertion passage to narrow to a size smaller than the size of the annular flange, thereby preventing said annular flange from being able to be removed from the first insertion passage, the closure mechanism being attached to the annular lid.

Alternatively, the retainer element will cause the second insertion passage to narrow. However in this case, for the retention of the lid to occur, said at least one central rib must include portions of side grooves located in at least two different halves of the lid, and the retainer element must be at least partially inserted in said portions of side grooves.

For manufacturing said lid with the groove portions, the use of glass pressed in a mold provided with more than two parts is preferably proposed.

In any case, the retainer element reduces the size of the insertion passage through which the lid has been inserted into the closure mechanism, preventing it from being able to be removed again.

According to an embodiment of the proposed invention, the retainer element will be an elastically deformable element.

In one embodiment, said elastically deformable retainer element will be attached under elastic strain around the central rib of the lid, the retainer element being partially inserted into said side grooves, being connected to the annular disc of the closure mechanism by contact.

According to another embodiment, the elastically deformable retainer element will be attached under elastic strain to the tubular skirt externally surrounding it. In such case, the tubular skirt will include openings through which portions of said retainer element are introduced into the first insertion passage constricting it and reducing the free section of passage.

Alternatively, the elastically deformable retainer element may be inserted by pressure into the first insertion passage, the tubular skirt including openings or seats in which portions of said retainer element are fitted fixing the position of the retainer element inside the first insertion passage. In other words, the retainer element will be introduced into the compressed first insertion passage and its expansion will keep it pressed against openings or maintain it on seats made in the wall of the tubular skirt where it will be partially inserted, preventing its accidental removal.

The proposed elastically deformable retainer element can be, for example, an annular spring or an elastic ring or an open ring, made of, for example, a metallic or plastic material.

According to another embodiment of the invention, the retainer element can be a plastically deformed portion of the closure device producing a bulging which constricts the first or second insertion passage.

The closure mechanism may be, for example, metallic or plastic, which allows creating said plastic deformation by applying pressure or pressure and heat, after the insertion of the lid into the first insertion housing.

It is proposed that the engagement configuration of the closure mechanism mentioned above will be a thread formed in the tubular skirt, said thread being complementary to the thread of the receptacle to allow their attachment.

Alternatively, said engagement configuration can consist of a plurality of thickenings arranged around the first open end of the tubular skirt, said thickenings projecting from the tubular skirt towards the inside of the first insertion passage, said plurality of thickenings being complementary to the thread of the receptacle. If the closure mechanism is metallic, said plurality of thickenings may be formed by a fold of the edge of the tubular skirt.

According to another embodiment of the invention, the at least one central rib includes at least two diametrically opposing portions defining between them a central passage going through the lid diametrically and going through the center thereof, said two diametrically opposing portions having supporting planes perpendicular to the front side of the lid.

This allows a user to introduce a lever element, such as a knife, a handle of a piece of cutlery, or a toothpick in said central passage, the lever element being supported on the lid. A rotation applied on that lever element will cause it to come into contact with the supporting planes of the two diametrically opposing portions of the central rib, allowing the application of torque on the lid, causing the rotation thereof with respect to the rest of the container.

In addition or as an alternative to the preceding features, it is also proposed to include discrete protuberances of a thickness smaller than the thickness of the sealing ring on:

- the face of the annular flange facing the sealing ring; or
- the annular mouth surface facing the sealing ring, or
- the face of the sealing ring facing the annular flange; or
- the face of the sealing ring facing the annular mouth surface.

Said protuberances will not prevent the hermetic sealing of the container, given that by having a thickness smaller than the thickness of the sealing ring, the flattening of said sealing ring under the force exerted by the closure mechanism can bear said irregularity the protuberance entails, keeping the sealing leak-tight, particularly with the protuberance being rounded edges and slightly inclined. Preferably, the thickness of said protuberance will be less than half the thickness of the sealing ring.

However, once the lid is released from the closure mechanism, the same elastic force of the sealing ring will push the protuberance and facilitate the spontaneous breaking of the hermetic sealing, allowing the entry of outside air through spaces adjacent to the discrete protuberances.

It is furthermore preferably contemplated for each of said discrete protuberances to consist of an elongated bulge which traverses the face on which they are formed from the outer perimeter to the inner perimeter of the element in which they are formed, thereby facilitating the entry of air from the outside to the inside of the container when the closure mechanism is released.

Each of said protuberances preferably consists of a bulge which traverses the face on which they are formed from the outer perimeter to the inner perimeter of the element in which they are formed.

The lid may furthermore include at the back side thereof a rear centering rib of a smaller diameter than the receptacle opening, provided for being inserted into said mouth when the lid is in the closed position, and wherein the rear centering rib will consist of an annular perimetral groove in which the sealing ring will be partially fitted.

This feature assures that the sealing ring remains attached to the lid also in the open position, preventing it from going missing.

According to a proposed additional embodiment, said annular flange of the lid has a thickness equal to or less than 5 mm, this being a reduced thickness which allows obtaining a lid and closure mechanism assembly with a small height.

The sealing ring will preferably have a thickness equal to or less than 2.1 mm, which will also help in reducing the visible part of the lid and closure mechanism assembly, as this thickness is smaller than usual.

Furthermore, this reduced thickness will require lower pressure of the closure mechanism to obtain hermetic closure.

Other features of the invention will become apparent in the following detailed description of an embodiment.

BRIEF DESCRIPTION OF THE DRAWINGS

The foregoing and other advantages and features will be better understood based on the following detailed description of an embodiment with reference to the attached drawings which must be interpreted in an illustrative and non-limiting manner, in which.

DETAILED DESCRIPTION OF AN EMBODIMENT

Figure 1:
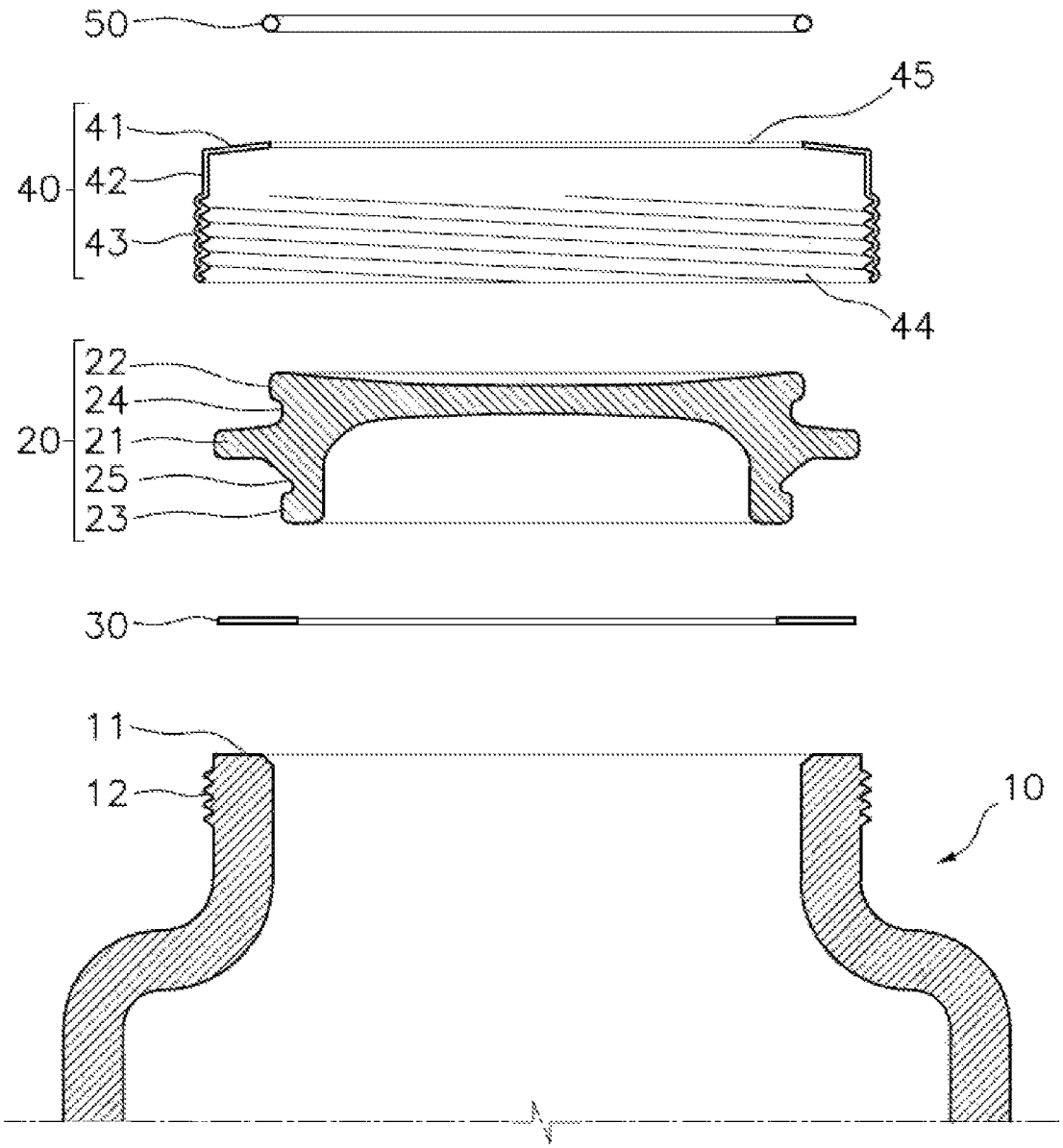
FIG. 1 is an exploded vertical cross-section view of the different components of the container with a hermetic closure according to a first proposed embodiment in which the retainer element is an open metallic ring provided for surrounding the central rib of the lid, being partially inserted into portions of side grooves of the central rib.

The attached drawings show illustrative non-limiting embodiments of the present invention.

FIGS. 1, 2, 3, 4, 6, and 7 show a receptacle 10 which, according to the present embodiment, is proposed to be made of glass. Said receptacle 10 defines a cylindrical mouth 11 around which there is a thread 12 made of the same glass forming the receptacle 10. The mouth 11 contains an annular mouth surface 14 surrounding a receptacle opening 13 which provides access to the inside of the receptacle.

The opening 13 is closed by means of a lid 20 which, in the present embodiment, will also be made of glass, in the shape of a circular disc, plate, or dish. There is on the periphery of said lid 20 an annular perimetral flange 21 which, in a closed position, is superimposed on the annular mouth surface 14 of the receptacle 10, the rest of the lid 20 being of a smaller diameter than the diameter of the mentioned opening 13.

It will be understood that although the preferred embodiment is made of glass, both the receptacle 10 and the lid 20 can be made of other materials, such as ceramic, for example, or the use of plastic is even optionally contemplated.

There is located between the annular flange 21 and the mouth 11 a sealing ring 30 which is held between the annular flange 21 and the mouth 11 when the lid 20 is in the closed position, providing hermetic closure. This sealing ring 30 will preferably be made of a flexible elastomeric material which, when pressed between the lid 20 and the receptacle 10, will be pressed causing hermetic sealing.

The lid 20 includes at its front side not facing the mouth 11 a central rib 22 projecting from the plane defined by the annular flange 21.

The lid 20 may optionally furthermore include a rear centering rib 23 at its back side oriented towards the receptacle 10, said rear centering rib 23 being of a smaller diameter than the opening 13 of the receptacle 10.

In these examples, the central rib 22 and the rear centering rib 23 are both in the form of a cylindrical wall with approximately one and the same diameter, so they are arranged one on top of another.

The annular flange 21 is located between said central rib 22 and rear centering rib 23, such that said ribs form a step at both the front side and the back side with respect to the annular flange 21.

To hold the glass lid 20 against the mouth 11 of the glass receptacle 10, causing hermetic sealing, a closure mechanism 40 consisting of a planar circular disc 41 with a hollow center with a cylindrical-shaped tubular skirt 42 extending along the periphery thereof is used.

Said tubular skirt 42 includes an engagement configuration 43 which will be complementary to the thread 12 of the receptacle 10, such that it allows screwing the closure mechanism 40 on the receptacle 10, thereby holding the annular flange 21 against the mouth 11 of the receptacle 10, assuring hermetic closure.

Figure 2:
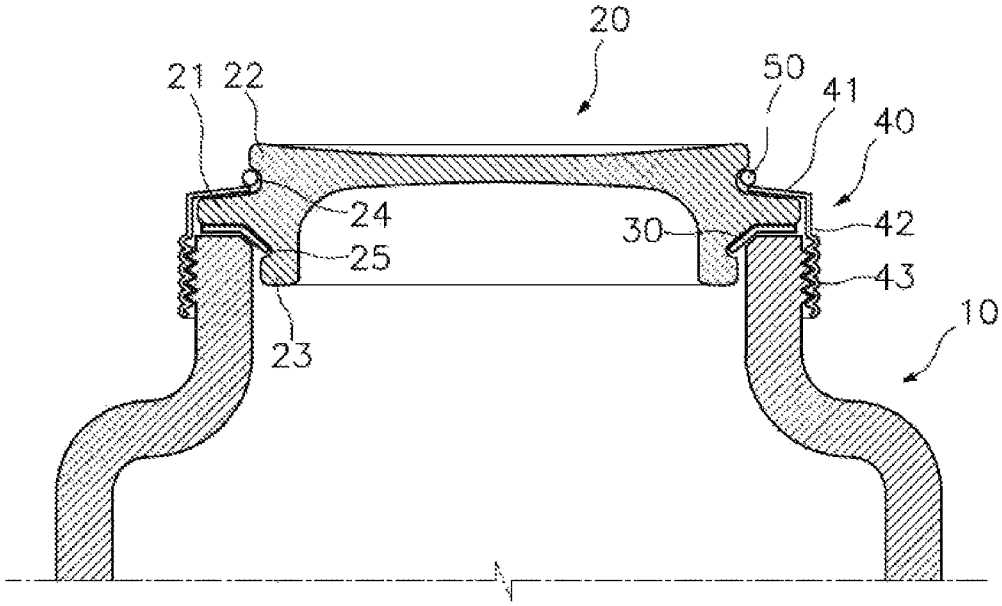
FIG. 2 is a vertical cross-section view of the same embodiment as FIG. 1 but in an assembled, not exploded view, in a closed position.
Figure 3:
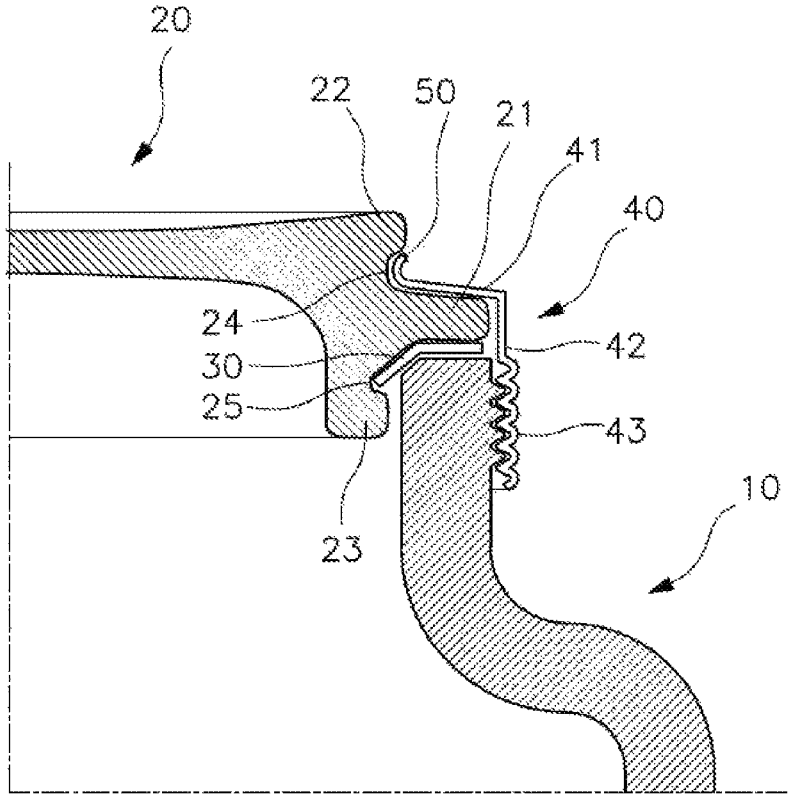
FIG. 3 is a vertical cross-section view of the enlarged view of FIG. 2 but according to an alternative embodiment in which the retainer element is a plastic deformation of a part of the annular disc of the closure mechanism, said retainer element being partially inserted into the portions of annular groove of the central rib.

The engagement configuration 43 can be, for example, a thread formed by the inner face of the tubular skirt 42, complementary with the thread 12 of the receptacle 10, as shown in FIGS. 1, 2, and 3.

Alternatively, it is contemplated for the edge of the mentioned tubular skirt 42 to have, at its end farthest from the disc 41, a discontinuous thickening configured for engaging with the thread 12 of the receptacle by way of an engagement configuration 43, thereby providing the hermetic closure of the lid 20 with the receptacle 10.

Figure 4:
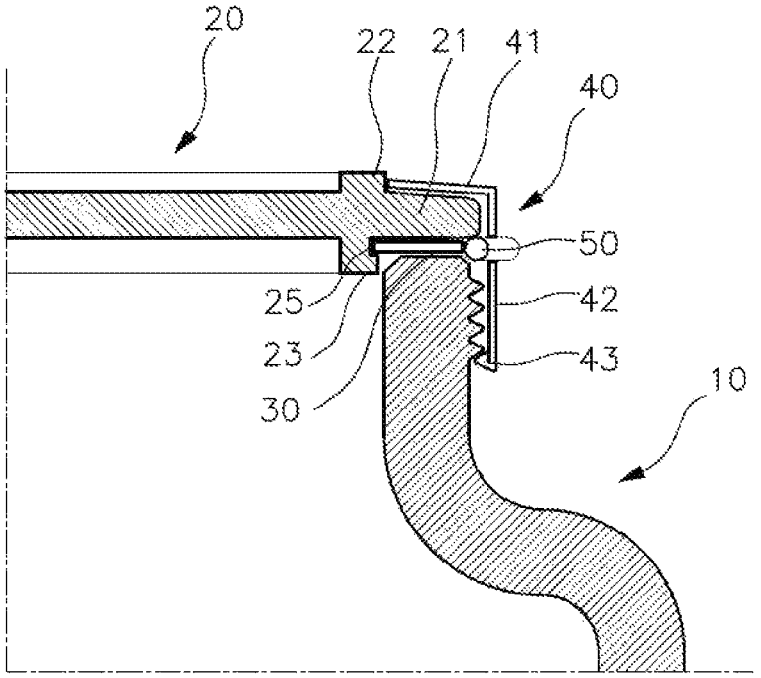
FIG. 4 is a vertical cross-section view of an alternative embodiment according to which the tubular skirt is surrounded by a ring-shaped retainer element under elastic pressure which has portions inserted into the first insertion passage through openings provided on said tubular skirt.
Figure 6:
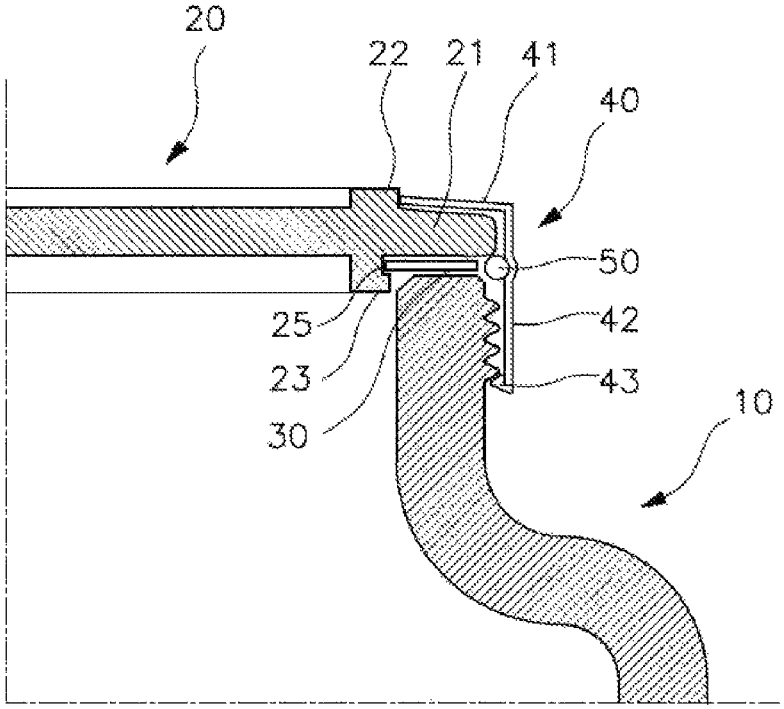
FIG. 6 is a vertical cross-section view of an embodiment similar to that shown in FIG. 4 but according to which the retainer element is inserted by pressure into the first insertion passage, being surrounded by the tubular skirt and fitted in a seat provided on the inner face of said tubular skirt.
Figure 7:
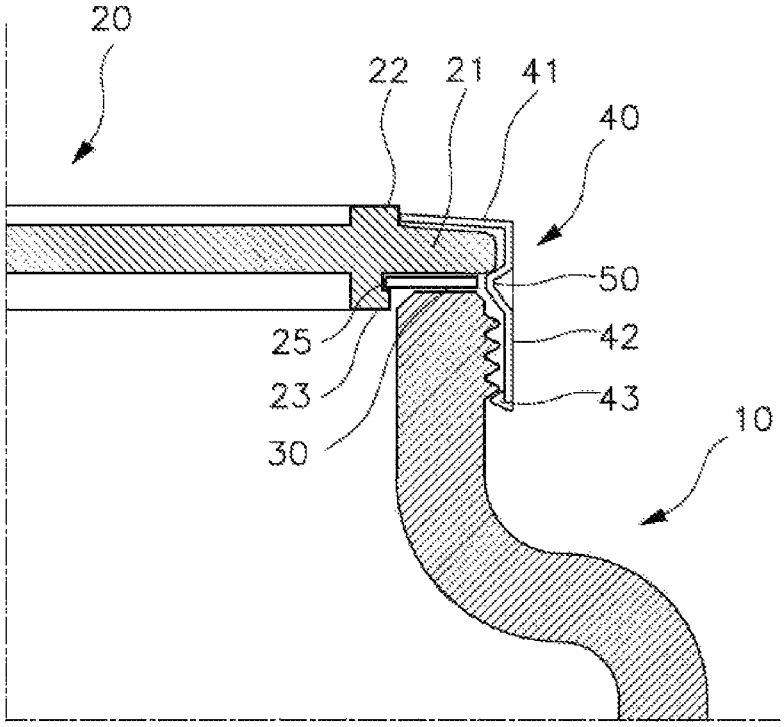
FIG. 7 is a vertical cross-section view according to an alternative embodiment in which the retainer element is a plastic deformation made in the wall of the tubular skirt towards the inside of the first insertion passage.

FIGS. 4, 6, and 7 show an engagement configuration 43 formed by a fold of the edge of the tubular skirt 42, which will preferably be metallic in this embodiment, for example stainless steel.

In any case, the closure mechanism 40 defines a first insertion passage 44 which corresponds to the space surrounded by the tubular skirt 42 and is partially closed at one end by the annular disc 41, provided for insertion of the lid 20, and it also defines a second insertion passage 45 corresponding to the central hollow of the annular disc 41 provided for the insertion of the central rib 22 of the lid 20 therethrough.

Therefore, the first insertion passage 44 will have a size equal to or greater than the maximum size of the lid 20, corresponding to the perimeter of the annular flange 21, said size being sufficient to allow the insertion of the lid 20 into the closure mechanism 40.

The second insertion passage 45 will have a size equal to or greater than the size of the central rib 22 of the glass lid 20, such that said central rib 22 can be inserted into the second insertion passage, allowing the rest of the annular disc 41 to be supported on the front side of the annular flange 21.

It will be understood that the expression "size equal to" also covers those cases in which there is a small difference in size which requires the application of certain force or even a small deformation to achieve insertion.

It is proposed to include features provided for assuring the joint rotation of the closure mechanism 40 with the lid 20 during screwing and unscrewing.

The rotation of the glass lid 20 facilitates the breaking of the hermetic closure, facilitating the entry of air into the container in the event that there is a certain degree of vacuum inside the container.

To achieve this joint rotation of the closure mechanism 40 with the lid 20, it is proposed for the second insertion passage 45 to have a non-circular shape, and for the central rib 22 of the front side of the lid 20 to have a shape and size complementary with the shape and size of the second insertion passage 45, allowing them to be coupled to one another and preventing their relative rotation.

Figure 8:
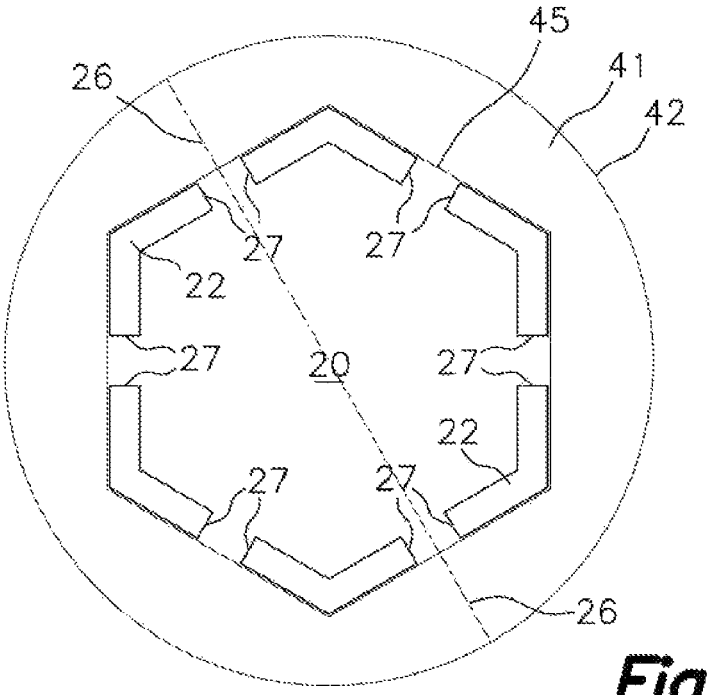
FIG. 8 is a plan view of the lid attached to a closure mechanism according to an embodiment in which the second passage defined in the annular disc of the closure mechanism is polygonal, in this case in the shape of a hexagon, and in which the central rib of the lid is an also hexagonal base wall the outer perimeter of which is slightly smaller than the inner perimeter of the second insertion passage, said hexagonal base wall being interrupted by three central passages going through the lid diagonally, forming three pairs of diametrically opposing portions.

In the example shown in FIG. 8, the second insertion passage 45 is hexagonal and the central rib 22 is in the form of a wall with a hexagonal base. Other polygonal shapes would also be acceptable, achieving the same effect.

It is also considered that the mentioned effect can be achieved without the central rib 22 reproducing the geometry of the second insertion passage 45, i.e., in the example of the hexagonal second insertion passage 45, the central rib can be, for example, in the shape of a six-pointed star, or consist of six protuberances coinciding with the corners of the hexagon, i.e., any shape contained within the shape of the second insertion passage 45 but occupying the areas farthest from the center of the lid will obtain said desired effect.

Figure 9:
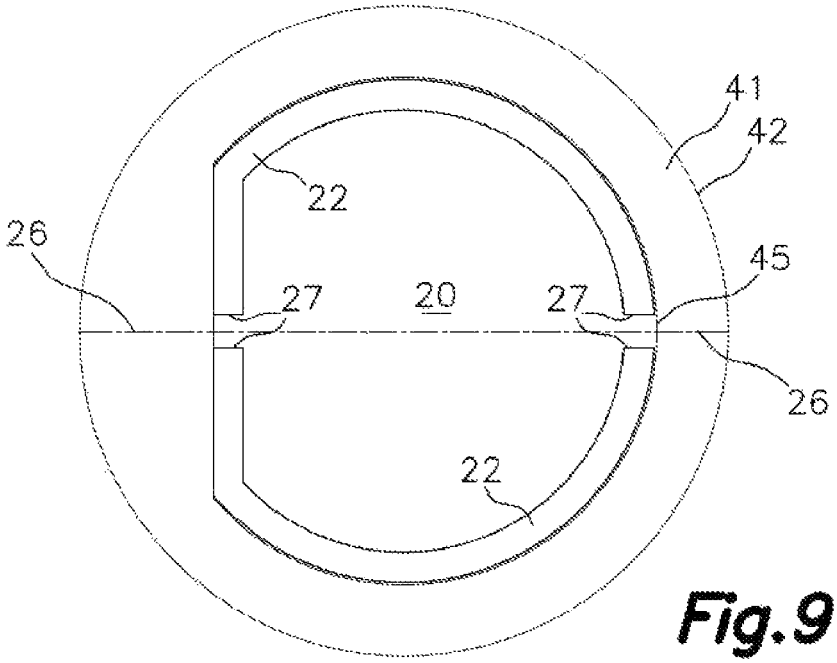
FIG. 9 is a plan view of an alternative embodiment with respect to that shown in FIG. 8 but in which the second insertion passage and the central rib have a circular shape with one side clipped, having only one central passage in this example.

Another embodiment is the one shown in FIG. 9 which shows a second insertion passage 45 and a central rib 22 in the shape of a circle with one side clipped.

According to another embodiment of the invention, it is proposed for the sought effect to be achieved by means of engagement between the tubular skirt 42 and the annular flange 21, said engagement being achieved by means of a non-circular geometry.

Figure 10:
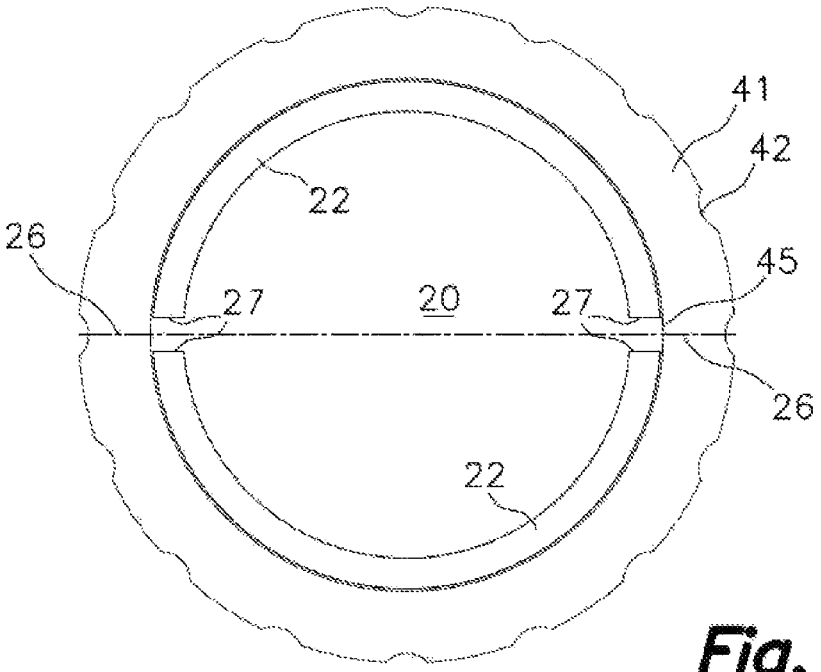
FIG. 10 is a plan view of an alternative embodiment with respect to that shown in FIGS. 8 and 9 in which the tubular skirt has notches oriented towards the inside of the first insertion passage and coupled to complementary notches provided on the perimeter of the annular flange of the lid.
Figure 11:
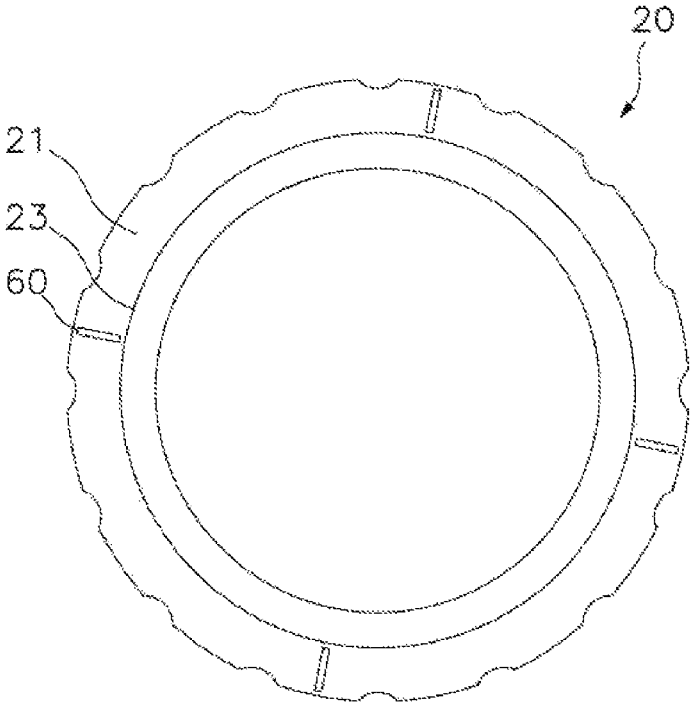
FIG. 11 is a plan view of the rear face of the lid according to the same embodiment shown in FIG. 10 in which the annular flange includes notches on the perimeter thereof provided for being fitted in the notches provided in the tubular skirt, this embodiment furthermore including discrete protuberances on the rear face of the annular flange facing the sealing ring.

In the embodiment shown in FIGS. 10 and 11, it is proposed for the annular flange 21 to have on the perimeter thereof a plurality of notches, and for the tubular skirt 42 to also include notches complementary with those of the annular flange 21, causing their engagement, preventing relative rotation between both elements.

It is furthermore proposed to include other features intended for the unscrewing of the closure mechanism 40 to cause the lid 20 to move away from the receptacle 10, thereby helping to break the hermetic closure and the entry of air in the receptacle 10. Different alternatives are proposed to achieve same.

According to the embodiments shown in FIGS. 1, 2, and 3, the central rib 22 has a height greater than that of the annular disc 41, so it protrudes above same when it is supported on the annular flange 21.

There are included around the central rib 22 at least portions of side grooves 24 accessible from the side of said central ribs 22, above the position of the annular disc 41, when it is in the closed position.

Said portions of side grooves 24 can completely surround the central rib 22 or can consist of a plurality separated partial grooves all arranged on one and the same plane around the central rib 22, with at least two of said partial grooves being located in different halves of the lid 20. This arrangement assures a secure coupling of the lid 20 to the closure mechanism 40 along the entire perimeter.

According to the present embodiment shown in FIGS. 1, 2, and 3, the invention proposes including a retainer element 50 at least partially surrounding the portion protruding from the cylindrical wall of the central rib 22, with the portions of the retainer element 50 being at least partially inserted into said portions of side groove 24, while at the same time other portions of the retainer element 50 will be attached to the annular disc 41 of the closure mechanism 40, anchoring the lid 20 to the closure mechanism 40.

According to the embodiment shown in FIGS. 1 and 2, the retainer element 50 will consist of an elastic ring, such as an open metallic ring or a ring made of gum or another elastic material, for example, inserted under elastic strain into the portions of side groove 24 of the central rib 22 of the lid 20. Said retainer element 50 will be partially supported on portions of the annular disc 41, with the annular disc 41 and retainer element 50 assembly determining a narrowing of the second insertion passage 45, the lid 20 therefore being retained in the closure mechanism 40.

In the present example, said retainer element 50 consists of an open metal washer with certain elastic capacity. To arrange the mentioned metallic washer around the central rib 22, it must be elastically opened, being partially retained inside the groove 24 under elastic strain.

The groove 24 will preferably be continuous around the central rib 22, but it is alternatively contemplated for it to be able to consist of different separated groove segments arranged around the central rib 22.

In any case, by coupling the retainer element 50 to the groove 24, part of said retainer element 50 will project radially from the periphery of the central rib 22, such that the central hollow of the disc 41 of the closure mechanism 40 is of a size smaller than that of said retainer element 50, therefore preventing the separation of the closure mechanism 40 from the rest of the glass lid 20.

This prevents parts of the assembly from going missing, while at the same time allows pulling on the closure mechanism 40, pulling along with it the glass lid 20 to overcome the vacuum that may exist inside the receptacle 10, therefore allowing the glass lid 20 to be unscrewed and removed in a single operation.

Figure 5:
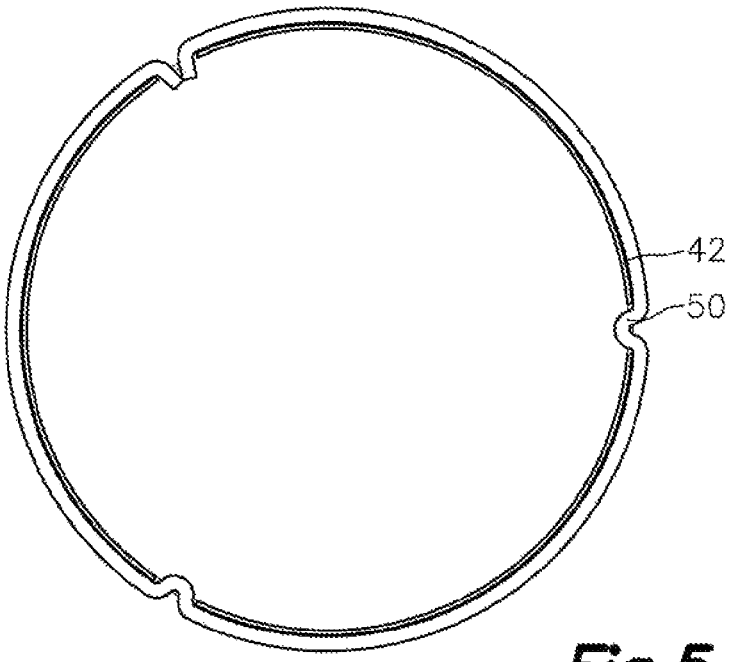
FIG. 5 is a horizontal cross-section view of the embodiment shown in FIG. 4, showing the tubular skirt surrounded by the retainer element in the form of a metallic ring, and the openings of the tubular skirt with the portions of the retainer element inserted therethrough.

The embodiment shown in FIGS. 4 and 5 is similar to the preceding embodiment, but the retainer element 50 in the form of an elastic washer surrounds the tubular skirt 42 in this case. At certain points, the tubular skirt 42 has openings through which an appendage of the retainer element 50 will be introduced into the first insertion passage 44, reducing its size to a size smaller than that of the annular flange 21, and therefore preventing the removal of the lid 20 from inside the closure mechanism 40.

FIG. 5 shows another view of this same embodiment in which it can be seen that the mentioned appendages are folds of the elastic washer, which is proposed to be metallic in this case.

Alternatively, the washer may be made of plastic or an elastic material such as gum, rubber, or latex, said appendages therefore being included as extensions of the same washer.

Another proposed embodiment shown in FIG. 6 consists of the insertion of the retainer element 50 in the form of an elastic washer into the first insertion passage 44, said retainer element 50 being subjected to elastic strain therein, pressing against the lower surface of the tubular skirt 42.

There will be provided on said lower surface a seat, for example in the form of an annular groove, or isolated openings, located below the annular flange 21, with the receptacle being in the vertical position. The retainer element 50 or parts thereof will be partially inserted into said seat or into said openings fixing the position of the retainer element 50 inside the closure mechanism 40.

Another alternative embodiment is the one shown in FIG. 3 in which the retainer element 50 is not a ring, but rather a portion of the closure mechanism 40 which extends from the annular disc 41 and has been plastically deformed after the insertion of the lid 20 into the closure mechanism 40 to be arranged partially inserted into the portions of side groove 24 of the central rib 22 of the lid. In this case, the retainer elements 50 can be, for example, tabs extending from the edge of the annular disc 41 demarcating the second insertion passage 45.

FIG. 7 shows an embodiment similar to the one described above, but in which the retainer element 50 is a plastic deformation of a part of the tubular skirt 42 located below the annular flange 21 of the lid 20, with the receptacle 10 being in the vertical position.

This plastic deformation forming the retainer element 50 determines a protuberance of the tubular skirt 42 towards the inside of the first insertion passage 44, reducing the free passage to a size smaller than the size of the annular flange 21 and therefore preventing the removal of the lid 20 from inside the closure mechanism 40.

Another feature proposed by the invention is the incorporation of at least one central passage 26 in the lid 20, formed by interruptions of the central rib 22 which will split it into diametrically opposing portions located in different halves of the lid 20.

Each portion of the central rib 22 will have supporting planes 27 perpendicular to the front side of the lid 20 facing the central passage 26, allowing the insertion of a lever arm, such as a knife, a handle of a piece of cutlery, or a toothpick, for example, through the central passage 26, said lever arm being supported on two supporting planes 27 of two diametrically opposing portions of central rib 22, allowing the transfer of torque to the lid 20 through said lever arm.

This feature can help to overcome the vacuum existing inside the receptacle 10, facilitating the opening of the lid 20.

Said feature can be combined with the proposed coupling between the lid 20 and the closure mechanism 40 in the direction of rotation, as shown in FIGS. 8, 9, and 10, such that the lever arm allows rotating the lid 20 together with the closure mechanism 40, to initiate the opening of the container, for example, or it can be independent of same, which allows overcoming the vacuum inside the container by means of rotating the lid 20 using the lever arm without this causing the rotation of the closure mechanism 40, which must be unscrewed manually.

FIG. 11 shows another embodiment in which the face of the front side of the annular flange 21 consists of four radial protuberances 60 uniformly spaced apart from one another.

Each protuberance 60 is in the form an elongated bulge traversing the width of the face of the annular flange 21 on which they are arranged, from the outer periphery to the inner periphery. Each protuberance 60 has a thickness equal to half the thickness of the sealing ring 30.

This protuberance 60 will be integrated in the sealing ring 30 when pressure is exerted on the lid 20 with the closure mechanism 40, achieving hermetic closure.

However, when pressure is released each protuberance 60 will facilitate a point of entry of air towards the inside of the container during the opening process thereof, facilitating the breaking of the vacuum which may exist therein.

Though not depicted in the drawings, it is contemplated that said protuberances 60 are located in the mouth 11 or on one of the two annular faces of the sealing ring 30.

It will be understood that the different parts forming the invention described in one embodiment can be freely combined with the parts described in other different embodiments even though said combination has not been explicitly described, provided that the combination does not entail any drawback.

The invention claimed is:

1. A container with a lid and threaded closure mechanism, the container including:

a glass receptacle provided with a mouth including a receptacle opening, an annular mouth surface surrounding said receptacle opening, and a thread externally surrounding said mouth;

a glass lid with a front side and a back side, said lid including an annular perimetral flange which, in a closed position, is superimposed on the annular mouth surface of the receptacle, and at least one central rib protruding from the front side of the lid;

a sealing ring arranged and held between the annular mouth surface of the receptacle and the annular flange of the lid;

a closure mechanism movable between a closed position and an open position, the closure mechanism being formed by a tubular skirt with a first open end and a second end closed by means of an annular disc attached along its outer perimeter to the tubular skirt, said tubular skirt being provided with an engagement configuration complementary to the thread of the receptacle;

wherein a lower surface of the tubular skirt surrounds and defines a first insertion passage the size of which is equal to or greater than the external size of the annular flange of the lid and the depth of which is greater than the thickness of the annular flange; and the annular disc has in the center thereof a hole the inner perimeter of which surrounds and defines a second insertion passage, the size of which is smaller than the size of the first insertion passage and the external size of the annular flange and greater than or equal to the size of the at least one central rib of the lid;

in the closed position the annular flange is inserted into the first insertion passage and in contact with the annular disc of the closure mechanism, the at least one central rib is inserted into the second insertion passage, the tubular skirt is arranged around the mouth, and the engagement configuration of the closure mechanism is coupled to the thread;

the lower surface of the tubular skirt defining the first insertion passage and a perimetral area of the annular flange facing the lower surface of the tubular skirt, or the inner perimeter of the hole of the annular disc defining the second insertion passage and the perimetral area of the central rib facing said inner perimeter of the hole of the annular disc have a complementary non-circular geometry and size, and are tightly fitted preventing relative rotation of the closure mechanism with respect to the lid.

2. The container according to claim 1, wherein the perimetral area of the central rib has the same shape as the second insertion passage and the same size or a size that is at most 3 mm smaller.

3. The container according to claim 1, wherein the central rib is in the shape of a polygon, ellipse, sinuous contour, star, cross, symbol, letter, word, number, or a truncated circular shape or circular shape with notches on the perimeter thereof.

4. The container according to claim 1, wherein the perimetral area of the annular flange is in the shape of a polygon, flute, sinuous contour, or a truncated circular shape or circular shape with notches on the perimeter thereof.

5. The container according to claim 1, wherein:

a retainer element is connected to the closure mechanism constricting the first insertion passage retaining the annular flange attached to the closure mechanism preventing the removal of the lid; or a retainer element is connected to the closure mechanism constricting the second insertion passage, portions of the retainer element being inserted into portions of side grooves located in areas of the at least one central rib of the lid located at two different halves of the lid, retaining the at least one central rib attached to the closure mechanism preventing the removal of the lid.

6. The container according to claim 5, wherein the retainer element is an elastically deformable element attached under elastic strain around the central rib of the lid, the retainer element being partially inserted into said side grooves, being connected to the annular disc of the closure mechanism by contact.

7. The container according to claim 5, wherein the retainer element is an elastically deformable element attached under elastic strain to the tubular skirt externally surrounding it, the tubular skirt including openings through which portions of said retainer element are introduced into the first insertion passage constricting it.

8. The container according to claim 5, wherein the retainer element is an elastically deformable element attached under elastic strain to the tubular skirt inserted by pressure into the first insertion passage, the tubular skirt including openings or seats in which portions of said retainer element are fitted fixing the position of the retainer element inside the first insertion passage.

9. The container according to claim 5, wherein the retainer element is an annular spring or an elastic ring or an open ring.

10. The container according to claim 5, wherein the retainer element is a plastically deformed portion of the closure device producing a bulging which constricts the first or second insertion passage.

11. The container according to claim 5, wherein the closure mechanism is metallic or plastic.

12. The container according to claim 1, wherein the engagement configuration of the closure mechanism is a thread formed in the tubular skirt complementary to the thread of the receptacle.

13. The container according to claim 1, wherein the engagement configuration consists of a plurality of thickenings which are provided around the first open end of the tubular skirt and project from the tubular skirt into the first insertion passage, said plurality of thickenings being complementary to the thread of the receptacle.

14. The container according to claim 13, wherein the closure mechanism is metallic and wherein said plurality of thickenings is formed by a fold of the edge of the tubular skirt.

15. The container according to claim 1, wherein the at least one central rib includes at least two diametrically opposing portions defining between them a central passage going through the lid diametrically, said two diametrically opposing portions having supporting planes perpendicular to the front side of the lid.

16. The container according to claim 1, wherein discrete protuberances of a thickness smaller than the thickness of the sealing ring are included on:

a face of the annular flange facing the sealing ring; or the annular mouth surface facing the sealing ring, or a face of the sealing ring facing the annular flange; or a face of the sealing ring facing the annular mouth surface.

17. The container according to claim 16, wherein each of said protuberances consists of a bulge which traverses the face on which they are formed from the outer perimeter to the inner perimeter of the element in which they are formed.

18. The container according to claim 1, wherein the lid includes at the back side thereof a rear centering rib of a smaller diameter than the receptacle opening, provided for being inserted into said mouth when the lid is in the closed position, and wherein the rear centering rib consists of an annular perimetral groove in which the sealing ring is partially fitted.

19. The container according to claim 1, wherein said annular flange has a thickness equal to or less than 5 mm, and/or wherein the sealing ring has a thickness equal to or less than 2.1 mm.

20. The container according to claim 1, wherein the receptacle and/or the lid are made of glass or ceramic, or wherein the receptacle and/or the lid are made of plastic.

21. The container according to claim 5, wherein the retainer element is an element made of metal or plastic material.

* * * * *